US012460384B2

(12) United States Patent
Charvieux et al.

(10) Patent No.: US 12,460,384 B2
(45) Date of Patent: Nov. 4, 2025

(54) CONSTRUCTION EQUIPMENT

(71) Applicant: VOLVO CONSTRUCTION EQUIPMENT AB, Eskilstuna (SE)

(72) Inventors: Philippe Charvieux, La Tour du Pin (FR); Alexandre Gateau, Tresserve (FR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 0 days.

(21) Appl. No.: 18/966,789

(22) Filed: Dec. 3, 2024

(65) Prior Publication Data

US 2025/0179773 A1 Jun. 5, 2025

(30) Foreign Application Priority Data

Dec. 5, 2023 (EP) ..... 23214333

(51) Int. Cl.
*E02F 9/22* (2006.01)
*E02F 3/30* (2006.01)
*E02F 9/20* (2006.01)

(52) U.S. Cl.
CPC ..... *E02F 9/2203* (2013.01); *E02F 3/30* (2013.01); *E02F 9/2079* (2013.01)

(58) Field of Classification Search
CPC ..... E02F 9/2095; E02F 9/2203; E02F 3/425; F15B 2015/206
See application file for complete search history.

(56) References Cited

U.S. PATENT DOCUMENTS

| | | | | |
|---|---|---|---|---|
| 6,276,223 | B1 | 8/2001 | Kimura et al. | |
| 6,789,335 | B1 | 9/2004 | Kinugawa et al. | |
| 2022/0243421 | A1* | 8/2022 | Gateau | E02F 9/202 |
| 2023/0151830 | A1* | 5/2023 | Quan | F15B 1/024 60/327 |

FOREIGN PATENT DOCUMENTS

| | | | |
|---|---|---|---|
| CN | 111255764 | A | 6/2020 |
| EP | 0163602 | A2 | 12/1985 |
| EP | 0163602 | A3 | 6/1986 |

(Continued)

OTHER PUBLICATIONS

European Search Report, European Application No. 23214333, Completed May 8, 2024, 2 pages.

*Primary Examiner* — Abiy Teka
(74) *Attorney, Agent, or Firm* — Sage Patent Group

(57) ABSTRACT

A construction equipment comprises a working element and at least one actuation device for operating the working element relative to a support element of the construction equipment. The actuation device includes a carriage guided and movable along an axis, an electromechanical actuator, which, when activated, converts electrical power into a first force moving the carriage along the first axis, and a hydraulic actuator, which connects the carriage and a first element that is either the working element or the support element so as to move the working element relative to the support element with at least partly the first force when the electromechanical actuator is activated, and which, when activated, converts hydraulic power into a second force moving the first element and the carriage relative to each other.

15 Claims, 3 Drawing Sheets

(56) References Cited

FOREIGN PATENT DOCUMENTS

| | | | | | |
|---|---|---|---|---|---|
| EP | 4036316 | A1 | | 8/2022 | |
| KR | 102195463 | B1 | | 12/2020 | |
| KR | 20230056439 | A | | 4/2023 | |
| WO | WO-2016097784 | A1 | * | 6/2016 | ..... E02F 3/425 |
| WO | 2022239730 | A1 | | 11/2022 | |

* cited by examiner

CONSTRUCTION EQUIPMENT

CROSS REFERENCE TO RELATED APPLICATIONS

This application claims priority to European Patent Application No. 23214333.9, filed on Dec. 5, 2023, the disclosure and content of which is incorporated by reference herein in its entirety.

TECHNICAL FIELD

The present disclosure relates generally to construction equipment, specifically to a partly or fully electrically driven construction equipment.

The disclosure is applicable on working machines within the fields of industrial construction machines or construction equipment, in particular excavators and articulated haulers. Although the disclosure will be mainly described with respect to an excavator, the disclosure is not restricted to this particular machine, but may also be used in other working machines such as articulated haulers, dump truck and backhoe loaders, loaders, skid steer loaders, as far as these working machines comprise at least one actuation device for driving a working element of the working machines, such as a tool, a dipper or a boom.

BACKGROUND

In recent years, there has been a clear trend towards the electrification of vehicles, and thus a move away from the use of fossil fuels that cause greenhouse gas emissions. Electric vehicles also have the advantage of being much quieter than their thermal counterparts.

This trend is now spreading to construction machinery which, until now, has included a combustion engine driving a hydraulic pump. Gradually, internal combustion engines will be replaced by electric motors.

Thus, EP 4036316A1 proposes to replace hydraulic cylinders of a construction equipment with electromechanical actuators and to obtain a fully electrical construction equipment. Each of the various electromechanical actuators may be integrated into a support element of the construction equipment, relative to which the working element is moved by the electromechanical actuators, so that the electromechanical actuators are protected from shocks. However, the size and weight of some of the electromechanical actuators, especially those operating distal working elements, may induce some practical difficulties because of limited space in the associated support elements and/or because of a substantial offset weight for the construction equipment. In order to get around this problem, the size and weight of the concerned electromechanical actuators need to be restricted, which may impact significantly the performance of the construction equipment.

SUMMARY

According to a first aspect of the disclosure, a construction equipment comprises a working element, such as a terminal tool, a dipper or a boom, and at least one actuation device for operating the working element relative to a support element of the construction equipment, the at least one actuation device including:

a carriage which is guided and movable along a first axis, an electromechanical actuator which, when activated, converts electrical power into a first force moving the carriage along the first axis, and a hydraulic actuator, which connects the carriage and a first element that is either the working element or the support element so as to move the working element relative to the support element with at least partly the first force when the electromechanical actuator is activated, and which, when activated, converts hydraulic power into a second force moving the first element and the carriage relative to each other.

The first aspect of the disclosure may seek to provide a simple and efficient solution to give a satisfactory performance to a construction equipment having one or several electromechanical actuators with limited size and weight. A technical benefit may include taking benefits of kinematics of a carriage moved along an axis by an electromechanical actuator to add a hydraulic actuator connecting the carriage to the working element or the support element of the construction equipment. When the hydraulic actuator is deactivated, the hydraulic actuator behaves as a rigid bar; when the hydraulic actuator is activated, the hydraulic actuator provides a hydraulically generated force to move the carriage relative to the working or support element to which the hydraulic actuator is connected. In that way, when the hydraulic actuator is activated at the same time as the electromechanical actuator is activated, the above mentioned hydraulically generated force boosts the force coming from the electromechanical actuator, thereby allowing the size and weight of the electromechanical actuator to be minimized while operating the working element with substantial combined efforts and/or with a substantial combined stroke. Furthermore, when the hydraulic actuator is activated whereas the electromechanical actuator is deactivated, the working element is operable according to some specific movements, in particular short-stroke and rapid movements, such as an earth unclogging movement or a sprinkling movement, or short-stroke and high-effort movement, such as big rock tearing out. In any case, in so far as the electromechanical actuator can be limited in size and weight thanks to the hydraulic actuator added thereto, the electromechanical actuator is easier to be integrated and thus protected into the support or working element of the construction equipment and induces a limited offset weight.

Optionally, in some examples, when the electromechanical actuator and the hydraulic actuator are both activated, the second force boots the first force to operate the working element. A technical benefit may include improving the construction equipment, as explained above.

Optionally, in some examples, when the electromechanical actuator and the hydraulic actuator are both activated, the second force corresponds in magnitude to at least 50% of the first force. A technical benefit may include improving the construction equipment, as explained above.

Optionally, in some examples, when the electromechanical actuator is deactivated, the electromechanical actuator is lockable to hold in position the carriage along the first axis so as to operate the working element as a result of only the second force when the hydraulic actuator is activated. A technical benefit may include avoiding damage to the electromechanical actuator, as explained in detail later.

Optionally, in some examples, when the hydraulic actuator is activated, the hydraulic actuator deploys and retracts along a second axis having an inclination relative to the first axis, which changes when the electromechanical actuator is activated. A technical benefit may include providing a reliable and practical solution for the hydraulic actuator.

Optionally, in some examples, the hydraulic actuator has a neutral configuration, in which the extent of the hydraulic actuator along the second axis is unchanged when the hydraulic actuator is deactivated, and to which the hydraulic actuator is configured to return after being activated. A technical benefit may include improving control of the actuation device.

Optionally, in some examples, the hydraulic actuator has a first end, which is articulated on the carriage, and a second end, which is articulated on the first element. A technical benefit may include providing a practical and efficient arrangement of the hydraulic actuator.

Optionally, in some examples, the hydraulic actuator comprises a double-acting cylinder having two chambers, which are each connected to a hydraulic system of the construction equipment and which are selectively supplied with pressurized fluid from the hydraulic system to deploy, respectively retract, the hydraulic actuator. A technical benefit may include providing a reliable and practice implementation for the hydraulic actuator.

Optionally, in some examples, the double-acting cylinder includes a tube, in which the two chambers are arranged, and a single piston rod, which is movable relative to the tube as a result of fluid pressure in the two chambers. A technical benefit may include providing an efficient and cost-effective implementation for the hydraulic actuator.

Optionally, in some examples, the hydraulic system comprises a fluid storage, a pump adapted to pressurize fluid sent from the fluid storage to the two chambers, and an electrovalve adapted to control fluid supply to the two chambers. A technical benefit may include providing an efficient and cost-effective implementation for the hydraulic system.

Optionally, in some examples, the pump is a hydraulic pump driven by an electrical motor. A technical benefit may include providing a construction equipment that is all electrically powered, as explained in detail later.

Optionally, in some examples, the at least one actuation device includes at least two actuation devices, and the hydraulic system is at least partly common for the at least two actuation devices. A technical benefit may include providing a cost-effective solution.

Optionally, in some examples, the working element is a terminal tool including a bucket arranged at a distal end of an excavator arm of the construction equipment. A technical benefit may include providing an improved excavation arm.

Optionally, in some examples, the working element is rotatably mounted on the support element, the actuation device being configured to operate in rotation the working element relative to the support element. A technical benefit may include providing a practical solution.

Optionally, in some examples, the electromechanical actuator comprises an electric motor and a rod, which extends along the first axis and which transmits an output torque of the electric motor to the carriage to move the carriage along the rod with the first force. A technical benefit may include providing an efficient and reliable implementation for the electromechanical actuator.

The disclosed aspects, examples, and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

Figure 1:
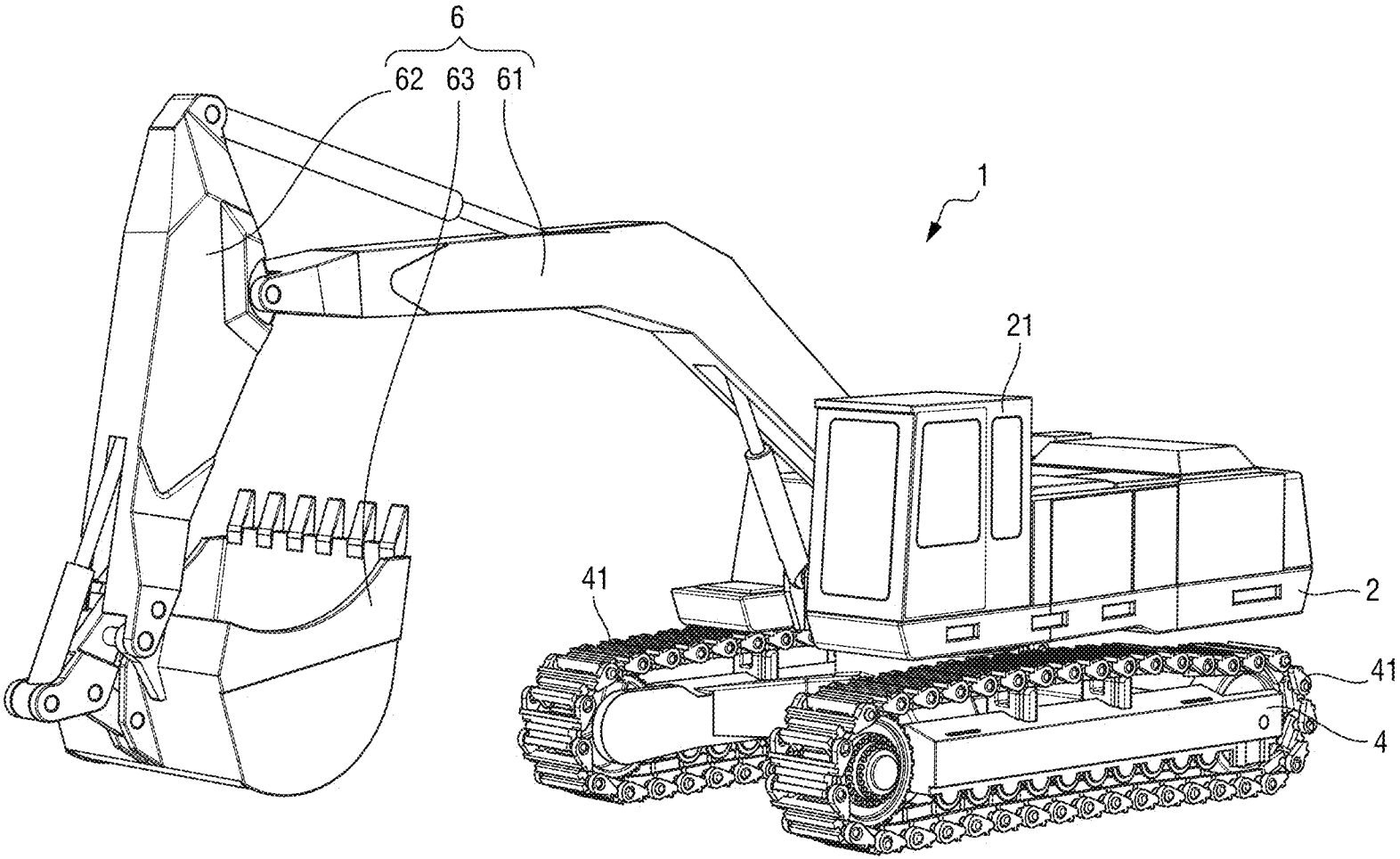
FIG. 1 is a perspective view of an exemplary construction equipment, here an excavator, according to an example.

The detailed description set forth below provides information and examples of the disclosed technology with sufficient detail to enable those skilled in the art to practice the disclosure. FIG. 1 shows a construction equipment 1 (also referred to as a "construction machine" or "work machine"), which in some examples, as here, is an excavator. Obviously, and as mentioned above, the disclosure is not limited to this particular example as it can be applied to any other construction machine.

The construction equipment 1 may comprise an upper frame 2, also called "platform", and a lower frame 4 on which the upper frame 2 is mounted. In some examples, as the one shown in the figures, the upper frame 2 includes a driver cab 21 and the lower frame 4 is equipped with a pair of continuous tracks 41, such as caterpillars tracks 41. The continuous tracks 41 may be driven by at least two electric motors (not shown), respectively one for each continuous track 41. Whatever the specific features of the upper frame 2 and the lower frame 4, the upper frame 2 may be pivotable around a vertical axis relative to the lower frame 4, the upper frame 2 being rotationally mounted on the lower frame 4.

The construction equipment 1 may further comprise an excavator arm 6 that extends from the upper frame 2. In some examples, as the one shown in the figures, the excavator arm 6 may include, successively from the upper frame 2, a boom 61, a dipper 62, also called "stitch", and a terminal tool 63. As best seen on FIG. 2, the terminal tool 63 is arranged at a distal end of the excavator arm 6, that is to say the end of the latter, which is opposed to the upper frame 2.

Figure 2:
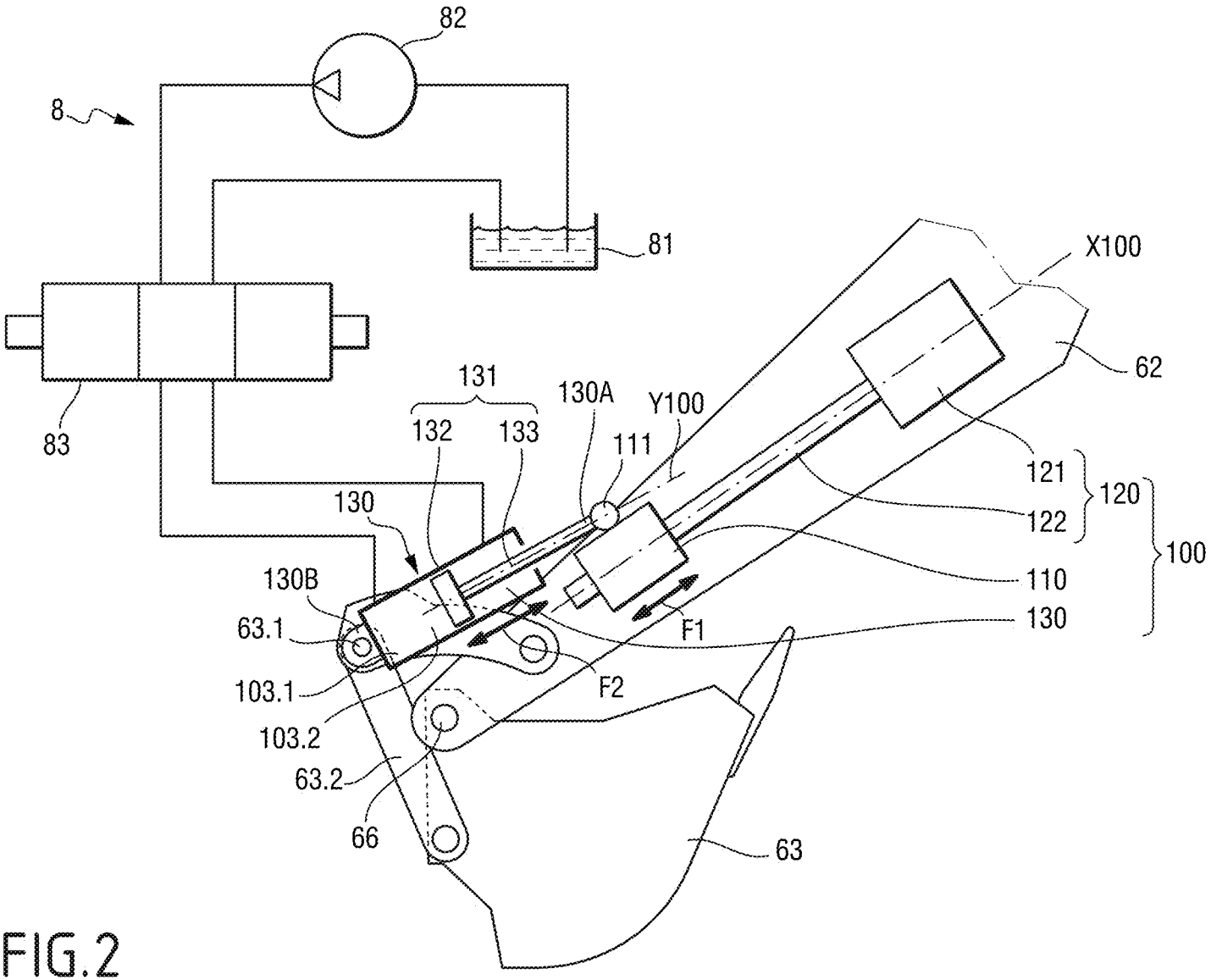
FIG. 2 is a schematic view of a bucket of the excavator of FIG. 1, according to an example.
Figure 3:
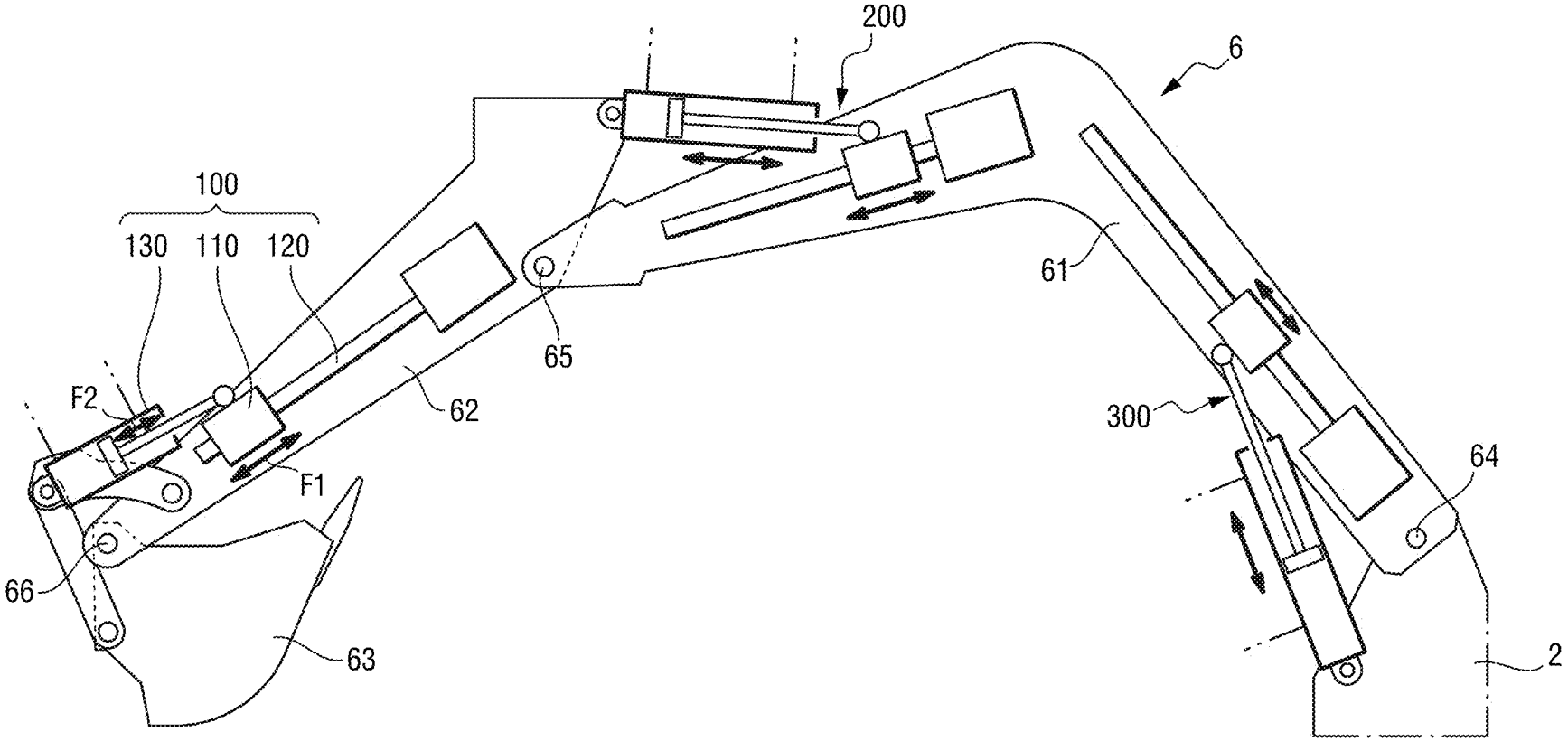
FIG. 3 is a side view of an arm of the excavator, including a boom, a dipper and the bucket, according to an example.

As best seen on FIG. 3, the boom 61 may be rotatably mounted on the upper frame 2. For this purpose, the excavator arm 6 includes an articulation 64, or hinge, between the upper frame 2 and the boom 61. On FIG. 3 and on FIG. 2 too, circles/rounds schematically represent hinge linkages or similar. In some examples, as the one shown in the figures, the boom 61 is angle-shaped, which means that the boom 61 includes two straight segments that delimit between them an angle of approximately 120° here.

The dipper 62 may be rotatably mounted on the boom 61. For this purpose, the excavator arm 6 includes an articulation 65, or hinge, between the boom 61 and the dipper 62.

The terminal tool 63 may be rotatably mounted on the dipper 62. For this purpose, the excavator arm 6 includes an articulation 66, or hinge, between the dipper 62 and the terminal tool 63. In practice, the terminal tool 63 is advantageously removably attached to the dipper 62. In the example shown in the figures, the terminal tool 63 is a bucket for working the soil.

In some examples, as the one shown in the figures, the articulations 64, 65 and 66 allow rotating the boom 61, the dipper 62 and the terminal tool 63 around respective rotation axes which are parallel to the ground surface on which the construction equipment 1 lays. Accordingly, when the construction equipment 1 lays on a flat horizontal surface, these rotation axes are horizontal. However, in not shown variants, the construction equipment includes one or several articulations, which are functionally similar to the articulations 64, 65 and 66 but whose rotation axes are not parallel to the ground surface.

As shown on the FIGS. 2 and 3, the construction equipment 1 comprises an actuation device 100 for operating the terminal tool 63 relative to the dipper 62. Thus, the actuation device 100 enables the terminal tool 63 to move relative to the dipper 62, here in rotation around the articulation 66.

The actuation device 100 comprises a carriage 110 and an electromechanical actuator 120. The carriage 110 is guided and movable along an axis X100, here relative to the dipper 62. The electromechanical actuator 120 enables, when activated, to convert electrical power into a force F1 moving the carriage 110 along the axis X100, here relative to the dipper 62. In practice, the force F1 is oriented along the axis X100, the direction of the force F1 depending on the direction in which the carriage 110 is moved along the axis X100 by the electromechanical actuator 120, namely forward or reward along the axis X100, as schematically indicated on FIG. 2.

The carriage 110, that can also be called "sliding member", has a wide variety of possible implementations, provided the carriage is moved along the axis X100 upon activation of the electromechanical actuator 120. The guidance of the carriage 110 along the axis X100, which may be rudimentary, is also implemented in various possible ways, if any by dedicated guiding means (not shown) that may be provided by the dipper 62, for example through a form-fit arrangement between the carriage 110 and a complementary part of the dipper 62.

In some examples, as the one shown in the figures, the electromechanical actuator 120 may comprise an electric motor 121 and a rod 122. Here, the electric motor 121 is fixedly carried by the dipper 62 and enables the conversion of electrical power into an output torque relative to the dipper 62. The rod 122 extends along the axis X100 and is configured to transmit the output torque of the electric motor 121 to the carriage 110 to move the carriage 110 along the rod 122 with the force F1.

In practice, the carriage 110 may be mounted on the rod 122 and the carriage 110 and the rod 122 may be typically connected one with the other through a ball or roller screw connection, meaning that the rod 122 includes external threads in which are received a multitude of rolling elements, such as balls, and the carriage 110 is secured to a nut comprising internal threads which are complementary to the external threads of the rod 122. More generally, the carriage 110 and the rod 122 may form a helical link that is achieved by contact between at least two helical surfaces. For instance, this helical link is achieved by using a ball screw or roller screw mechanism using rolling elements, such as balls or rollers, to limit friction between the rod 122 and the carriage 110. As this type of helical connection is well known in the art, no further details are given here. In any case, the rod 122, which is typically rotationally coupled with an output shaft of the electric motor 121, may be fixed in position relative to the dipper 62. Whatever the specific features for the carriage 110, for the electrical motor 121 and for the rod 122, an activation of the electric motor 121 leads to a rotation of the rod 122 around the axis X100 and therefore to a displacement of the carriage 110 with the force F1, this displacement being rearward or forward, depending on rotation direction of the output shaft of the electric motor 121.

The actuation device 100 further comprises a hydraulic actuator 130. The hydraulic actuator 130 connects the carriage 110 and the terminal tool 63 to each other so that, whether the hydraulic actuator 130 is activated or deactivated, the hydraulic actuator 130 moves the terminal tool 63 relative to the dipper 62 with at least partly the force F1 when the electromechanical actuator 120 is activated. In other words, here, the hydraulic actuator 130 is configured, whether the hydraulic actuator 130 is activated or deactivated, to move the terminal tool 63 and transmits to the latter at least partly the force F1 when the electromechanical actuator 120 is activated. Moreover, the hydraulic actuator 130 enables, when activated, to convert hydraulic power into a force F2 moving the terminal tool 63 relative to the carriage 110.

Thus, when the hydraulic actuator 130 is deactivated, the hydraulic actuator 130 behaves as a rigid bar to transmit to the terminal tool 63 at least partly the movement of the carriage 110 and at least partly the force F1 upon activation of the electromechanical actuator 120. When the hydraulic actuator 130 is activated, the terminal tool 63 is moved relative to the carriage 110 with the force F2.

In that way, when the electromechanical actuator 120 and the hydraulic actuator 130 are both activated, the force F2 boosts the force F1 to operate the terminal tool 63. In other words, the hydraulic actuator 130 acts as a force booster for the electromechanical actuator 120. In practice, this boosting from the hydraulic actuator 130 may be substantial in the sense that the force F2 may correspond in magnitude to at least 50% of the force F1. Thus, the magnitude of force F2 may be at least 50% the magnitude of force F1, but may also be at least 100% or even 200% of the magnitude of the force F1.

In any case, combining the activation of the electromechanical actuator 120 and the activation of the hydraulic actuator 130, and thus boosting the force F1 with the force F2 have a number of advantages. In fact, when the terminal tool 63 is to be operated with a large or even very large effort, the force F2 produced by the hydraulic actuator 130 complements the force F1 produced by the electromechanical actuator 120, thus satisfying the need for this large or even very large effort without the electromechanical actuator 120 having to be oversized as a result. In other words, it is sufficient for the electromechanical actuator 120 to be dimensioned so that the force F1 it generates satisfies a nominal requirement covering common uses of the terminal tool 63, while the hydraulic actuator 130 can be dimensioned so that the force F2 it generates satisfies the complement necessary to the force F1 to exceed the aforementioned nominal requirement, i.e., typically during force peaks for the terminal tool 63. In practice, the electromechanical actuator 120 is more appropriate than the hydraulic actuator 130 for the aforementioned nominal requirement, in the sense that the electromechanical actuator 120 is faster and more efficient for the nominal type of work, while providing its F1 force with a limited but still substantial magnitude. In this way, the hydraulic actuator 130, as a booster for the electromechanical actuator 120, provides not speed, but additional force. As a result, the size and weight of the electromechanical actuator 120 can be minimized, by relying on the booster effect of the hydraulic actuator 130 when the nominal requirement is exceeded. Similarly, activating the hydraulic actuator 130 can help to maintain the amplitude of movement of the terminal tool 63, while reducing the stroke of the electromechanical actuator 120, thus helping to size the latter more compactly and lightly. Minimizing the size and weight of the electromechanical actuator 120 in this way is highly advantageous, as it facilitates integration and, hence, impact protection of the electromechanical actuator 120 within the excavator arm 6, and limits the overhang resulting from the presence of the electromechanical actuator 120 on the excavator arm 6. These advantages are even more pronounced when the electromechanical actuator 120 is located close to the distal end of the excavation arm 6, as is the case for the electromechanical actuator 120 of the actuator 100 acting on the end tool 63.

When the hydraulic actuator 130 is activated whereas the electromechanical actuator 120 is deactivated, the terminal tool 63 is operable as a result of only the force F2 upon activation of the hydraulic actuator 130. In that case, to avoid any damage of the electromechanical actuator 120 due to the reaction load generated by the hydraulic actuator 130 in the actuation device 100, the electromechanical actuator 120 may be configured, when deactivated, to be locked to hold in position the carriage 110 along the axis X100. In practice, any locking arrangement that firmly immobilizes the carriage 110 along the axis X100 is feasible, such a locking arrangement of the electromechanical actuator 120 being known in the art.

In any case, activating the hydraulic actuator 130 while the electromechanical actuator 120 is deactivated enables to operate the terminal tool 63 in movements that would be difficult for the electromechanical actuator 110 to achieve, such as a sprinkling movement, an earth unclogging movement, a movement for excavating large rocks, and so on.

In some examples, as the one shown in the figures, the hydraulic actuator 130 may be configured, when activated, to deploy and retract along an axis Y100. The force F2 is oriented along this axis Y100, the direction of the force F2 depending on the direction in which the hydraulic actuator 130 operates, i.e., deploys or retracts, as schematically indicated on FIG. 2. As clearly shown by FIG. 2, the axis Y100 is distinct from the axis X100, especially in the sense that the axis Y100 has an inclination relative to the axis X100, which changes when the electromechanical actuator 120 is activated. For this purpose, in the example shown in the figures, the hydraulic actuator 130 may be articulated relative to the carriage 110 and the terminal tool 63. More precisely, the hydraulic actuator 130 has a first end 130A, which is articulated on the carriage 110, and a second end 130B, which is articulated on the terminal tool 63. Thus, the first end 130A of the hydraulic actuator 130 may be attached to a hinge 111 of the carriage 110 and the second end 130B of the hydraulic actuator 130 may be attached to a hinge 63.1 of the terminal tool 63, as shown in FIG. 2. This hinge 63.1 belongs here to a set of connecting rods-linkages 63.2 of the terminal tool 63, which is well known in the art and which enables to drive the main body of the terminal tool 63 in rotation around the articulation 66.

The hydraulic actuator 130 may have a neutral configuration, for example the one that is shown on the figures. In this neutral configuration, the extents of the hydraulic actuator 130 along the axis Y100 is unchanged when the hydraulic actuator 130 is deactivated. Moreover, after being activated, the hydraulic actuator 130 is configured to return to this neutral configuration. In that way, kinematics of the actuation device 100 are precisely managed whether the hydraulic actuator is activated or deactivated.

Various implementations are possible for the hydraulic actuator 130. In some examples, as the one shown in the figures, the hydraulic actuator 130 may comprise a double-acting cylinder 131 having two chambers 131.1 and 131.2 that are configured to be selectively supplied with a pressurized fluid, such as oil, to deploy, respectively retract, the hydraulic actuator 130. As schematically shown on FIG. 2, each of the chambers 131.1 and 131.2 is connected to a hydraulic system 8 of the construction equipment 1, which enables the hydraulic system 8 to supply the chambers with pressurized fluid. In that way, when the chamber 131.1 is supplied with pressurized fluid from the hydraulic system 8 while the chamber 131.2 is not, the hydraulic actuator 130 deploys; when the chamber 131.2 is supplied with the pressurized fluid from the hydraulic system 8 while the chamber 131.1 is not, the hydraulic actuator 130 retracts.

According to a practical and efficient implementation, the double-acting cylinder 131 may include a tube 132, in which the two chambers 131.1 and 131.2 are arranged, and a single piston rod 133, which is movable relative to the tube 132 as a result of fluid pressure in the two chambers 131.1 and 131.2. Here, the first end 130A and the second end 130B of the hydraulic actuator 100 belong respectively to the piston rod 133 and the tube 132, but the reverse is feasible. Of course, other implementation of the double-acting cylinder 131 is feasible.

Whatever the specific features of the double-acting cylinder 131, the hydraulic system 8 may comprise a fluid storage 81, a pump 82 and an electrovalve 83. The fluid storage 81 contains sufficient fluid to operate the hydraulic system 8 and includes for example a tank that is filled with fluid. The pump 82 connects the fluid storage 81 to the electrovalve 83 and enables the pressurized fluid to be sent from the fluid storage 81 to the chambers 131.1 and 131.2 through the electrovalve 83. The electrovalve 83 is configured to control fluid supply to each of the two chambers 131.1 and 131.2. In particular, in a first configuration of the electrovalve 83, the pressurized fluid coming from the pump 82 here sent by the electrovalve 83 to the chamber 131.1 while the fluid exhausting from the chamber 131.2 is sent by the electrovalve 83 directly to the fluid storage 81; in a second configuration of the electrovalve 83, the fluid pressurized by the pump 82 is sent by the electrovalve 83 to the chamber 131.2 while the fluid exhausting from the chamber 131.1 is sent by the electrovalve 83 directly to the fluid storage 81. Thus, the hydraulic system 8 is simple, reliable and robust. Of course, the hydraulic system 8 may be implemented in other ways.

In any case, the pump 82 of the hydraulic system 8 may be a hydraulic pump driven by an electrical motor. In other words, the pump 82 may be electrically powered. In that way, the construction equipment 1 may be entirely electrically powered, in the sense that this construction equipment 1 does not include any thermal engine and is designed to activate by electrical primary power all the force-producing components of the construction equipment 1, such as here the motors driven the continuous tracks 41, the electromechanical actuator 120 and the pump 82.

As shown on FIG. 3, the construction equipment 1 may comprise, in addition to the actuation device 100, an actuation device 200, which is similar to the actuation device 100 but which is dedicated to operate the dipper 62 relative to the boom 61, here in rotation around the articulation 65, and/or an actuation device 300, which is similar to each of the actuation devices 100 and 200 but which is dedicated to operate the boom 61 relative to the upper frame 2, here in rotation around the articulation 64. Thus, each of the actuation devices 100, 200 and 300 enables the operation of a working element of the construction equipment 1 relative to a support element of the construction equipment 1, the working element and the support element being respectively either the terminal tool 63 and the dipper 62 for the actuation device 100, or the dipper 62 and the boom 61 for the actuation device 200, or the boom 61 and the upper frame 2 for the actuation device 300.

In practice, the respective specific features for the actuation device 100, for the actuation device 200 and for the actuation device 300 may or may not be the same for the three actuation devices. For example, unlike the actuation device 100 whose the hydraulic actuator 130 has its second end 130B that is articulated on the terminal tool 63, the hydraulic actuator of the actuation device 300 has its second end that is not articulated on the boom 61 but on the upper frame 2. By the way, it is clear that more generally, the hydraulic actuator of the actuation devices 100, 200 and 300 connects the carriage thereof to either the working element, as for the actuation devices 100 and 200, or the support element, as for the actuation device 300, so that, when the hydraulic actuator is activated, the force F2 moves the carriage relative to the working or support element to which the hydraulic actuator is connected. In any case, taking all the above into account, we see that the hydraulic actuator of each actuation device 100, 200, 300 provides additional effort but also dynamism, in other words responsiveness and speed, which is very useful, for example, for unclogging the terminal toll 63, i.e., removing soil stuck thereto, thanks to the actuation device 100, and for sprinkling thanks to the actuation device 200.

The hydraulic system 8 may be common to the three actuation devices 100, 200 and 300, especially in the sense that the single fluid storage 81 and the single pump 82 are used with three electrovalves that are respectively associated to the actuation devices 100, 200 and 300, such as the electrovalve 83 that is associated to the actuation device 100, as explained above.

According to a variant not shown, the actuation device to which it is referred to in this paper may be used to move an articulated blade of a construction equipment, which is fastened to a lower frame of the construction equipment, typically to the front of this lower frame for pushing material, such as soil, sand, snow or to stabilize the machine during excavating or lifting work.

Example 1

A construction equipment comprising a working element such as a terminal tool, a dipper or a boom, and at least one actuation device for operating the working element relative to a support element of the construction equipment, the at least one actuation device including (i) a carriage which is guided and movable along a first axis, (ii) an electromechanical actuator which, when activated, converts electrical power into a first force moving the carriage along the first axis, and (iii) a hydraulic actuator, which connects the carriage and a first element that is either the working element or the support element so as to move the working element relative to the support element with at least partly the first force when the electromechanical actuator is activated, and which, when activated, converts hydraulic power into a second force moving the first element and the carriage relative to each other.

Example 2

When the electromechanical actuator and the hydraulic actuator are both activated, the second force boots the first force to operate the working element.

Example 3

When the electromechanical actuator and the hydraulic actuator are both activated, the second force corresponds in magnitude to at least 50% of the first force.

Example 4

When the electromechanical actuator is deactivated, the electromechanical actuator is lockable to hold in position the carriage along the first axis so as to operate the working element as a result of only the second force when the hydraulic actuator is activated.

Example 5

When the hydraulic actuator is activated, the hydraulic actuator deploys and retracts along a second axis having an inclination relative to the first axis, which changes when the electromechanical actuator is activated.

Example 6

The hydraulic actuator has a neutral configuration, in which the extent of the hydraulic actuator along the second axis is unchanged when the hydraulic actuator is deactivated, and to which the hydraulic actuator is configured to return after being activated.

Example 7

The hydraulic actuator has a first end, which is articulated on the carriage, and a second end, which is articulated on the first element.

Example 8

The hydraulic actuator comprises a double-acting cylinder having two chambers, which are each connected to a hydraulic system of the construction equipment and which are selectively supplied with pressurized fluid from the hydraulic system to deploy, respectively retract, the hydraulic actuator.

Example 9

The double-acting cylinder includes a tube, in which the two chambers are arranged, and a single piston rod, which is movable relative to the tube as a result of fluid pressure in the two chambers.

Example 10

The hydraulic system comprises a fluid storage, a pump adapted to pressurize fluid sent from the fluid storage to the two chambers, and an electrovalve adapted to control fluid supply to the two chambers.

Example 11

The pump is a hydraulic pump driven by an electrical motor.

Example 12

The at least one actuation device includes at least two actuation devices, and the hydraulic system is at least partly common for the at least two actuation devices.

Example 13

The working element is a terminal tool including a bucket arranged at a distal end of an excavator arm of the construction equipment.

Example 14

The working element is rotatably mounted on the support element, the actuation device being configured to operate in rotation the working element relative to the support element.

Example 15

The electromechanical actuator comprises an electric motor and a rod, which extends along the first axis and which transmits an output torque of the electric motor to the carriage to move the carriage along the rod with the first force.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A construction equipment, comprising a working element, a dipper or a boom, and at least one actuation device for operating the working element relative to a support element of the construction equipment, the at least one actuation device including:

a carriage which is guided and movable along a first axis, an electromechanical actuator which, when activated, converts electrical power into a first force moving the carriage along the first axis, and a hydraulic actuator, which connects the carriage and a first element that is either the working element or the support element so as to move the working element relative to the support element with at least partly the first force when the electromechanical actuator is activated, and which, when activated, converts hydraulic power into a second force moving the first element and the carriage relative to each other.

2. The construction equipment according to claim 1, wherein when the electromechanical actuator and the hydraulic actuator are both activated, the second force boots the first force to operate the working element.

3. The construction equipment according to claim 1, wherein when the electromechanical actuator and the hydraulic actuator are both activated, the second force corresponds in magnitude to at least 50% of the first force.

4. The construction equipment according to claim 1, wherein when the electromechanical actuator is deactivated, the electromechanical actuator is lockable to hold in position the carriage along the first axis so as to operate the working element as a result of only the second force when the hydraulic actuator is activated.

5. The construction equipment according to claim 1, wherein when the hydraulic actuator is activated, the hydraulic actuator deploys and retracts along a second axis having an inclination relative to the first axis, which changes when the electromechanical actuator is activated.

6. The construction equipment according to claim 5, wherein the hydraulic actuator has a neutral configuration, in which the extent of the hydraulic actuator along the second axis is unchanged when the hydraulic actuator is deactivated, and to which the hydraulic actuator is configured to return after being activated.

7. The construction equipment according to claim 1, wherein the hydraulic actuator has a first end, which is articulated on the carriage, and a second end, which is articulated on the first element.

8. The construction equipment according to claim 1, wherein the hydraulic actuator comprises a double-acting cylinder having two chambers, which are each connected to a hydraulic system of the construction equipment and which are selectively supplied with pressurized fluid from the hydraulic system to deploy, respectively retract, the hydraulic actuator.

9. The constructing equipment according to claim 8, wherein the double-acting cylinder includes a tube, in which the two chambers are arranged, and a single piston rod, which is movable relative to the tube as a result of fluid pressure in the two chambers.

10. The construction equipment according to claim 8, wherein the hydraulic system comprises a fluid storage, a pump adapted to pressurize fluid sent from the fluid storage to the two chambers, and an electrovalve adapted to control fluid supply to the two chambers.

11. The construction equipment according to claim 10, wherein the pump is a hydraulic pump driven by an electrical motor.

12. The construction equipment according to claim 8, wherein the at least one actuation device includes at least two actuation devices, and wherein the hydraulic system is at least partly common for the at least two actuation devices.

13. The construction equipment according to claim 1, wherein the working element is a terminal tool including a bucket arranged at a distal end of an excavator arm of the construction equipment.

14. The construction equipment according to claim 1, wherein the working element is rotatably mounted on the support element, the actuation device being configured to operate in rotation the working element relative to the support element.

15. The construction equipment according to claim 1, wherein the electromechanical actuator comprises an electric motor and a rod, which extends along the first axis and which transmits an output torque of the electric motor to the carriage to move the carriage along the rod with the first force.

* * * * *